US005913255A

United States Patent [19]

Kikuchi et al.

[11] Patent Number: 5,913,255

[45] Date of Patent: Jun. 15, 1999

[54] RADIALLY ANISOTROPIC SINTERED R-FE-B-BASED MAGNET AND PRODUCTION METHOD THEREOF

[75] Inventors: Akira Kikuchi; Shigeho Tanigawa, both of Saitama-ken, Japan

[73] Assignee: Hitachi Metals Ltd., Tokyo, Japan

[21] Appl. No.: 08/908,427

[22] Filed: Aug. 7, 1997

[30] Foreign Application Priority Data

Aug. 9, 1996 [JP] Japan ..... 8-210655

[51] Int. Cl.[6] ..... C22C 29/14

[52] U.S. Cl. ..... 75/244; 148/302; 148/104; 335/302; 419/12

[58] Field of Search ..... 148/302, 104; 420/83, 121; 335/302; 75/244, 14 TD; 419/12

[56] References Cited

U.S. PATENT DOCUMENTS

| | | | |
|---|---|---|---|
| 4,678,634 | 7/1987 | Tawara et al. | 419/30 |
| 4,881,984 | 11/1989 | Chandhok et al. | 148/101 |
| 4,888,512 | 12/1989 | Shimizu | 310/156 |
| 4,960,469 | 10/1990 | Tanigawa et al. | 148/105 |
| 4,990,306 | 2/1991 | Ohashi | 419/28 |
| 5,342,574 | 8/1994 | Kasai et al. | 419/61 |

FOREIGN PATENT DOCUMENTS

| | | |
|---|---|---|
| 2-281721 | 11/1990 | Japan . |
| 4-163905 | 6/1992 | Japan . |
| 6-13217 | 1/1994 | Japan . |
| 7-161542 | 6/1995 | Japan . |

*Primary Examiner*—John Sheehan
*Attorney, Agent, or Firm*—Finnegan, Henderson, Farabow, Garrett, & Dunner

[57] ABSTRACT

A method of producing a radially anisotropic sintered R-Fe-B-based magnet wherein R is at least one rare earth element including Y, in which a green body stack comprising a plurality of compact bodies are formed in series by the same die. The density of the compact body is regulated to 3.1 g/cm$^3$ or more, and increased at the final compacting step to a density at least 0.2 g/cm$^3$ higher than that before the final compacting step. By so regulating the density of the green body, the cracking during the sintering process at the binding portion, an interface between the stacked compact bodies, can be minimized while retaining high magnetic properties of the resulting magnet.

13 Claims, 3 Drawing Sheets

RADIALLY ANISOTROPIC SINTERED R-FE-B-BASED MAGNET AND PRODUCTION METHOD THEREOF

BACKGROUND OF THE INVENTION

The present invention relates to a radially anisotropic sintered R-Fe-B-based magnet (R is at least one rare earth element including Y) for use in various application field such as motors, sensors, etc., and a production method thereof.

In the known methods of producing a sintered R-Fe-B-based magnet, a die having an axial length (length along the axial direction or the compacting direction) corresponding to the axial length (hereinafter referred to as "L") of a magnet to be produced. Therefore, a die having a large size in the compacting direction is required when a magnet having a large L. A large size of the die causes several problems such as a difficult handling of the die when mounting to or removing from the compacting apparatus, a large size of the compacting apparatus due to an excessively large compacting stroke.

The radially anisotropic sintered R-Fe-B-based magnet (hereinafter referred to as "R.R. magnet") has been conventionally produced by a compacting apparatus which has a die constituting a magnetic circuit. An example for such a compacting apparatus is shown in FIG. 1. A cylindrical die 9 basically consists of a ferromagnetic portion 1, a non-magnetic portion 2 surrounded by a lower coil 7, and a core 3 made of a ferromagnetic material. A starting powder is charged into a cavity 10 defined by the outer peripheral surface of the core 3, the inner surface of the ferromagnetic portion 1 and the upper surface of a lower cylindrical punch 5 which is movable downward and upward along the axial direction. Then, an upper punch 4 surrounded by an upper coil 6, which is movable downward and upward along the axial direction, moves downward into the cavity 10 to compact the starting powder to produce a green body. The green body is then sintered to produce an R.R. magnet.

The intensity of the orientation magnetic field (Bg) applied to the cavity 10 is expressed by the following formula (1):

$$Bg=d^2\times\sigma_s/(4\times D\times Lm) \quad (1)$$

wherein d is an outer diameter of the core 3, D is an inner diameter of the die 9, Lm is a length of the ferromagnetic portion 1 in the compacting direction (axial direction), and $\sigma_s$ is a saturation magnetization of the core 3. To produce an R.R. magnet having a large L, Lm of the ferromagnetic portion 1 is required to be increased. However, Lm cannot be freely increased. Since Bg should be about 0.5 T (tesla) to magnetically orientate the starting powder in the cavity 10 in the radial direction and $\sigma_s$ is usually about 2 T, the value of Lm is limited by the following formula (2):

$$Lm\leqq d^2/D \quad (2).$$

With this limitation of Lm, an R.R. magnet having L exceeding the above limitation of Lm has been difficult to be produced in a single compacting operation. Therefore, such an R.R. magnet has been produced by binding a plurality of R.R. magnet parts produced by using a die having a small Lm satisfying the formula (2). However, this method suffers from the defect such as decreasing in the total magnetic flux due to the adhesive layers and/or treating layers present between the R.R. magnet parts and a high production cost due to an increased number of binding steps.

To remove the defect, several methods have been proposed in the prior art. Japanese Patent Laid-Open No. 2-281721 proposes a so-called multi-stage compacting method. In this method, a starting powder in the cavity surrounded by the ferromagnetic portion of the die is compacted into a first green body, which is then shifted downward to the space surrounded by the non-magnetic portion of the die to make the cavity empty. Into the empty cavity, a second amount of the starting powder is charged, compacted to form a second green body on the first green body, and then sifted downward together with the first green body to make the cavity empty again. Thus, the sequential process of charging the powder, compacting the powder and shifting downward the green body is repeated desired times to produce a green body stack which is sintered by a known method to obtain an R.R. magnet having a large L. However, in the proposed method, since each of the compacting steps is carried out under the same pressure, the green bodies have the same density, this resulting in the occurrence of cracking during the sintering process at the binding portion between the green bodies. In addition, since Lm is reduced to create a high orientation magnetic field in the cavity, the proposed method requires an increased number of compacting steps to attain a large L.

Japanese Patent Laid-Open No. 6-13217 proposes another method in which a second amount of starting powder is charged into vacant space in the cavity created by compacting a first amount of starting powder without shifting any green body downward. The sequential steps of charging the starting powder into the vacant space and compacting the starting powder are repeated until the green body stack reaches the desired L. In this method, each compacting step is carried out so that a green body has a density of about 3 g/cm$^3$, and the density of the green body stack is increased to about 4 g/cm$^3$ in the final compacting step. Although the proposed method can avoid the cracking occurred in the method proposed by Japanese Patent Laid-Open No. 2-281721, a green body stack having L larger than the axial length of the ferromagnetic portion of the die cannot be produced by the method.

The inventors tried to avoid the cracking in the method of Japanese Patent Laid-Open No. 2-281721 by combining the methods of Japanese Patent Laid-Open Nos. 2-281721 and 6-13217, namely, in the multi-stage compacting steps of Japanese Patent Laid-Open No. 2-281721, the density of the green bodies was regulated within 2 to 3 g/cm$^3$ and increased to 4 g/cm$^3$ in the final compacting step as taught by Japanese Patent Laid-Open No. 6-13217. Although the cracking was avoided, the resulting magnet was poor in magnetic properties. Also, although the length Lm was reduced to increase the orientation magnetic field intensity, the magnetic properties of the magnet were not improved corresponding to the increased orientation magnetic field.

Japanese Patent Laid-Open No. 7-161524 teaches that the cracking during the sintering process can be avoided by a binding layer rich in rare earth elements which is present between the green bodies. However, the resulting magnet is poor in the corrosion resistance due to a large amount of the corrosive rare earth elements contained in the binding layer even when the magnet is subjected to a surface treatment for improving the corrosion resistance.

OBJECT AND SUMMARY OF THE INVENTION

Accordingly, an object of the present invention is to provide an R.R. magnet having a large L and magnetic properties sufficient for practical use.

Another object of the present invention is to provide a multi-stage production method of the above R.R. magnet, which can avoid the cracking during the sintering process and reduce the number of the compacting steps to lower the production cost.

The inventors produced a 5-stack green body by repeating five times the cycle of charging the starting powder into the cavity, compacting the starting powder and shifting downward the resulting green body to the space surrounded by the non-magnetic portion of the die while regulating the density of the green body to 3 g/cm$^3$ up to the fourth compacting step and to 4 g/cm$^3$ at the final (fifth) compacting step. However, as mentioned above, the magnetic properties of the magnet obtained from the green body stack were insufficient for practical use. In the present specification, the compacting steps prior to the final step (final compacting step) are called as "precompacting step" and the green body obtained in each precompacting step is called as "precompact body." The green body stack after the final compacting step is called as "final compact body."

As a result of the intense research in view of the above objects, the inventors have found that the magnetic properties of the multi-stage magnet and the cracking during the sintering step are largely influenced by the density of the precompact body and the density of the final compact body. In the multi-stage production, the precompact body is sifted to the space surrounded by the non-magnetic portion of the die by moving both the die and the core upward while fixing both the upper and lower punches, or by moving both the upper and lower punches downward while fixing the die and core. During the shifting, the precompact body moves in frictionally contacting with both the inner surface of the die and the outer surface of the core. When the density of the precompact body is 2 to 3 g/cm$^3$, the powder particles in the precompact body move or rotate due to the friction between the surface of the die and/or core because the precompact body includes a large number of voids. Therefore, the orientation of the powder particles in the direction of the orientation magnetic field is disordered by the movement and rotation of the powder particles, thereby deteriorating the magnetic properties. The inventors have found that the precompact body can be sifted to the space surrounded by the non-magnetic portion without causing the movement and rotation of the powder particles when the density of the precompact body is 3.1 g/cm$^3$ or more.

When the density difference between the precompact body and the final compact body is small, the cracking at the binding portion between the green bodies is likely to occur during the sintering step. The inventors have found that the cracking can be effectively avoided when the density of the final compact body is 0.2 g/cm$^3$ or more higher than that of the precompact body.

The present invention has been accomplished by the above findings. Thus, in a first aspect of the present invention, there is provided a method of producing a radially anisotropic sintered R-Fe-B-based magnet wherein R is at least one rare earth element including Y, which method comprises the steps of (1) forming a plurality of precompact bodies in series in a die, each of the plurality of precompact bodies having a density of 3.1 g/cm$^3$ or more; (2) compacting the plurality of precompact bodies to form an integral final compact body having a density which is at least 0.2 g/cm$^3$ higher than that of the plurality of precompact bodies; (3) sintering the final compact body; and (4) magnetizing a surface of the sintered body.

A second aspect of the present invention, there is provided a radially anisotropic sintered R-Fe-B-based magnet wherein R is at least one rare earth element including Y, produced from a green body stack having at least four compact body in series, wherein an axial length between any of adjacent binding portions each of which corresponds to an interface between the stacked compact bodies is 80 to 100% of the maximum axial length between adjacent binding portions.

A third aspect of the present invention, there is provided a radially anisotropic sintered R-Fe-B-based magnet wherein R is at least one rare earth element including Y, produced from a green body stack having at least two compact body in series, wherein a portion containing no binding portion which corresponds to an interface between the stacked compact bodies has a degree of orientation of 83 to 88%, the degree of orientation being defined by the following formula:

$$\text{degree of orientation}(\%)=Br(r)/(Br(r)+Br(c))\times 100$$

wherein Br(r) is a residual magnetic flux density in the radial direction and Br(c) is a residual magnetic flux density in the circumferential direction.

DETAILED DESCRIPTION OF THE INVENTION

Figure 1:
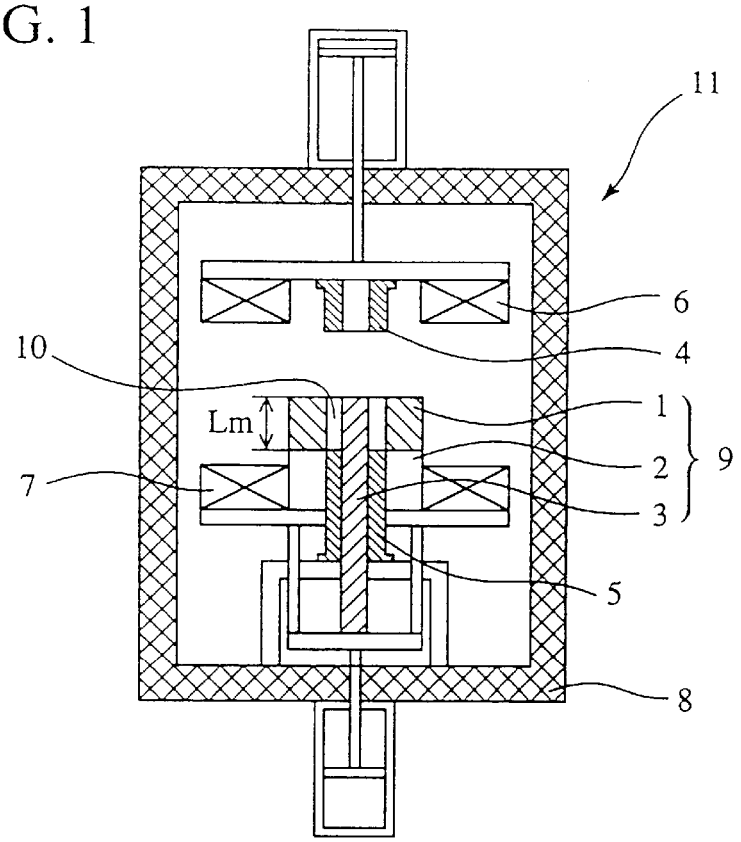
FIG. 1 is a cross sectional view showing a compacting apparatus for producing a cylindrical green body stack.

In the present invention, the R.R. magnet is produced by sintering a green body stack produced by a multi-stage compacting method using a compacting apparatus, for example, shown in FIG. 1. An amount of the starting powder is charged in the cavity 10 while fixing the lower punch 5 so that the cavity 10 defined by the inner surface of the die 9, the outer surface of the core 3 and the top surface of the lower punch 5 has an axial length same as the axial length (Lm) of the ferromagnetic portion 1 or slightly smaller than Lm. Then, the upper punch 4 moves downward to compact the starting powder in the cavity 10 to form a first precompact body while applying an orientation magnetic field generated by the pulse current flowing through the coil 6, 7. The density of the precompact body is 3.1 g/cm$^3$ or more, preferably 3.1 to 4.2 g/cm$^3$, and the orientation magnetic field is applied so that the intensity of the orientation magnetic field in the cavity 10 is magnetically saturated.

The first compact body is then shifted into the space surrounded by the non-magnetic portion 2 by moving the upper and lower punches 4 and 5 downward while fixing the die 9 and the core 3, or by moving the die 9 and the core 3 upward while fixing the upper and lower punches 4 and 5. When the top surface of the first precompact body is positioned lower than the lower end of the ferromagnetic portion 1, a lower part of the next amount of the starting powder is compacted in the cavity surrounded by the non-magnetic portion 2. Since the orientation magnetic field is quite weak in the cavity surrounded by the non-magnetic portion 2, the starting powder in the cavity is hardly oriented to form a weakly oriented portion which deteriorates the magnetic properties of the resultant R.R. magnet.

To eliminate this problem, the top surface of the sifted precompact body should be positioned at the same level of the lower end of the ferromagnetic portion 1 or higher. In the present invention, a portion of the sifted precompact body left in the cavity surrounded by the ferromagnetic portion 1 is called as "overlap portion" and the length of the overlap portion in the axial direction (compacting direction) is called as "overlap length." An excessively large overlap length prevents the next amount of the starting powder from being sufficiently oriented in the radial direction because the magnetic flux passes through the oriented overlap portion more easily than through the starting powder, thereby reducing the effective amount of the orientation magnetic field for orienting the starting powder. As will be described in Example 3, it has been found that an overlap length up to 20% of Lm (the axial length of the ferromagnetic portion 1) does not reduce the magnetic properties of the R.R. magnet.

After shifting the first precompact body as described above, a second amount of the starting powder is charged into the cavity 10 on the first precompact body, compacted by the upper and the lower punches 4 and 5 to form a second precompact body having a density of 3.1 g/cm$^3$ or more on the first precompact body. Then, the precompact body composed of the first and the second precompact bodies is shifted as described above. The sequential process of charging-compacting-shifting is repeated desired times in the same manner as above to form a precompact body stack. In the final compacting step, after shifting the precompact body stack in the same manner as above, the final amount of the starting powder is charged in the cavity 10 on the precompact body stack and compacted by the upper and the lower punches 4 and 5 to form a final compact body having a density larger than that of the precompact body by 0.2 g/cm$^3$ or more, preferably 0.2 to 1.5 g/cm$^3$. Alternatively, the final compacting step may be carried out by only further compacting the stack of the precompact bodies, without charging the final amount of the starting powder, to form the final compact body having a density as defined above. The final compact body is preferred to be a stack of at least two compact bodies, namely a stack having at least one binding portion.

The final compact body is then taken out of the compacting apparatus 11, and sintered by a method usually employed in the production of sintered rare earth magnets. For example, the sintering is carried out in an inert gas such as Ar, He, etc., in vacuum or in hydrogen at 1000 to 1200° C. for 1 to 7 hours. After sintering, the sintered body may be heat-treated, for example, in an inert atmosphere at 550 to 950° C. for several hours. After heat-treatment, machining, coating (Ni-coating, epoxy resin-coating, etc.), the sintered body is finally magnetized in the same direction as the orientation direction to obtain the R.R. magnet of the present invention.

As mentioned above, the overlap length of the sifted precompact body in the ferromagnetic portion 1 is 0 to 20% of the axial length Lm of the ferromagnetic portion 1. This means that the depth of the cavity 10 is 0.8×Lm to 1×Lm. Since the axial length between the adjacent binding portions (interbinding portion) of the R.R. magnet is proportional to the depth of the charged starting powder which is 0.8×Lm to 1×Lm, the axial length of each interbinding portion ranges from 80 to 100% of the maximum axial length of the interbinding portion. The interbinding portions of the magnet correspond to the compact bodies prepared in the second compacting stage to the compacting stage prior to the final compacting stage. The portions at both the axial end of the R.R. magnet, corresponding to the compact bodies prepared in the first compacting stage and the final compacting stage, are machined to regulate the axial length L of the R.R. magnet within a desired length according to the practical use. Therefore, in the R.R. magnet of the present invention, any one of the length of the interbinding portions, namely, an axial length between a binding portion and a next adjacent biding portion as shown by the reference numeral 21 in FIG. 2A is 80 to 100% of the maximum length of the interbinding portion, thereby ensuring to exhibit sufficient magnetic properties.

As mentioned above, although the orientation magnetic field intensity is increased by reducing the axial length of Lm, the R.R. magnet produced by the conventional method under a small Lm condition did not exhibit the increased total magnetic flux corresponding to the increase in the orientation magnetic filed intensity.

Figure 2A:
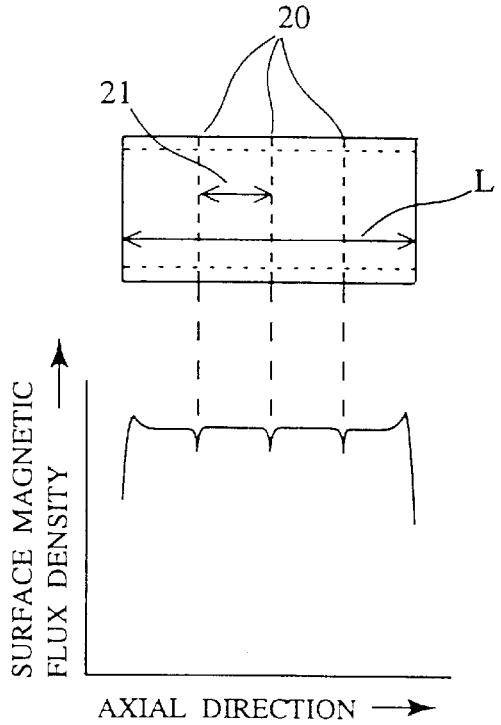
FIG. 2A is a graphic representation showing a relation between the binding portion of the R.R. magnet of the present invention and the distribution of surface magnetic flux density.
Figure 2B:
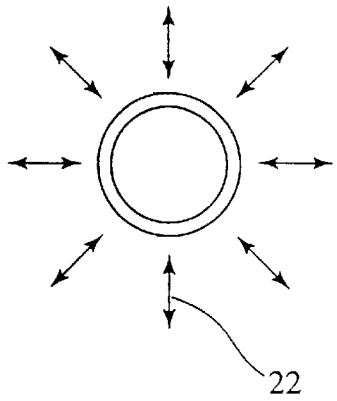
FIG. 2B is a schematic diagram showing the radial magnetic orientation of the R.R. magnet shown in FIG. 2A viewed from the axial direction.

A surface magnetic flux density of an R.R. magnet produced by the multi-stage compacting method shows a distribution in the axial direction (L direction) as shown in FIG. 2A. The dropped peaks of the distribution curve correspond to the binding portions 20 shown by broken lines. The binding portion is a portion at which a precompact body is made integral with an adjacent precompact body during the final compacting step and/or the sintering process, and can be easily specified as the dropped peak in the distribution curve of the surface magnetic flux density.

By using the same die while changing the number of the precompacting steps, several R.R. magnets of different number of interbinding portions were produced. The magnetic flux per unit length in L direction of each R.R. magnet thus produced was measured. As a result, it was found that the magnetic flux per unit length decreased with increasing number of the compacting steps (number of interbinding portions).

In the course of further researches, the inventors have noticed that a total magnetic flux comparable to that obtained in an R.R. magnet composed of an increased number of interbinding portions can be attained even when the number of the compacting steps, i.e., the number of the interbinding portions of R.R. magnet, is reduced by increasing the axial length of the ferromagnetic portion (Lm) of the die. Namely, it has been found that an R.R. magnet having sufficient magnetic properties can be produced even when Lm is larger than the limitation given by the formula (2).

Also, as a result of measuring B-H characteristics by a D.C. B-H tracer, it has been found that Lm and the degree of orientation of the R.R. magnet are closely related to each other.

The degree of the orientation of the R.R. magnet in the radial direction is defined by the following formula (3):

$$\text{Degree of orientation}(\%)=Br(r)/(Br(r)+Br(c))\times 100 \quad (3)$$

wherein Br(r) is a residual magnetic flux density in the radial direction and Br(c) is a residual magnetic flux density in the circumferential direction.

Figure 3:
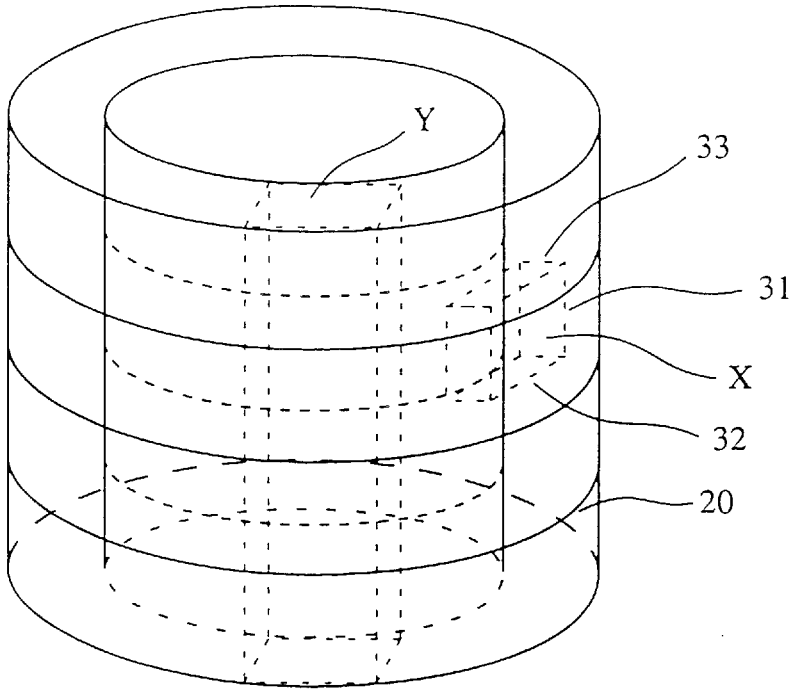
FIG. 3 is a schematic view showing the test pieces used in determining the degree of orientation.

A rectangular solid test piece shown by X in FIG. 3 and another rectangular solid test piece shown by Y in FIG. 3 were taken from two different multi-stage R.R. magnets which were the same in the size and nearly the same in the total magnetic flux, but different from each other in the number of compacting steps (number of interbinding portions). As seen from FIG. 3, the test piece X contained no binding portion therein and the axial length of the test piece Y was the same as the axial length (L) of the R.R. magnet. From the results of measuring B-H characteristics, the test piece X from the R.R. magnet with a larger number of interbinding portions (shorter Lm) showed Br(r) and the degree of orientation each higher than those of the test piece X from the other R.R. magnet. However, Br(r) and the degree of orientation were nearly the same in the test pieces Y from both the R.R. magnet. Further, as a result of further study on the test pieces X from several R.R. magnets produced by changing Lm and the number of compacting steps, it has been found that a test piece X having a degree of orientation of 83 to 93% shows high magnetic properties, and in particular, the number of the compacting steps can be reduced while retaining high magnetic properties when the degree of orientation is 83 to 88%. From the repeated measurements, it has been confirmed that a degree of orientation in the interbinding portion between the adjacent binding portions of the R.R. magnet, which corresponds to the test piece X, can be regulated within the range of 83 to 88% by suitably selecting Lm so as to satisfy the relation: $d^2/D<Lm\leqq 2.5\times d^2/D$. When Lm exceeds $2.5d^2/D$, the degree of orientation and the total magnetic flux are remarkably reduced. Thus, in the method of the present invention, Lm longer than those conventionally employed can be used, and therefore, the number of compacting steps can be reduced, this in turn reducing the production cost.

In the present invention, the inner diameter (D) of the die and the outer diameter (d) are preferably 10 to 200 mm and 7 to 150 mm, respectively. The axial length Lm of the ferromagnetic portion is restricted by the values of d and D, and preferably $0.2\times\times d^2/D\leqq Lm\leqq 2.5d^2/D$ (mm) when the degree of orientation of 83 to 93% is intended and $d^2/D<Lm\leqq 2.5\times d^2/D$ (mm) when the degree of orientation of 83 to 88% is intended.

The outer diameter (Φ) of the R.R.. magnet of the present invention is preferably 10 to 150 mm, more preferably 10 to 100 mm. An orientation magnetic field (Bg) having a sufficient intensity for ensuring the magnetic anisotropy is very difficult to obtain in industrial scale when the outer diameter is less than 10 mm. When the outer diameter exceeds 150 mm, the handling of the magnets becomes difficult. The ratio (L/Φ) of L (the axial length) and the outer diameter (Φ) of the R.R. magnet is preferably ⅓ or more, and more preferably ⅓ to 10.

The R.R. magnet of the present invention is R-Fe-B-based magnet, preferably R-Fe(Co)-B-M-based magnet. R is at least one rare earth element including Y and may be contained 25 to 35% by weight based on the total of the magnet. B (boron) may be contained 0.8 to 1.2% by weight based on the total of the magnet. M is at least one element selected from the group consisting of Al, Nb, Ti, V, Zr, Mo, W, Ga, Cu, Zn, Ge and Sn and may be contained 5% by weight or less based on the total of the magnet. A part of a balance of Fe may be substituted by Co. Preferred embodiments may be Nd-Fe-B-Al-Nb, Nd-Fe-Co-B-Al-Nb, Nd-Fe-B-Al-Ga, Nd-Fe-Co-B-Al-Ga, Nd-Dy-Fe-B-Al-Nb, Nd-Dy-Fe-Co-B-Al-Nb, Nd-Dy-Fe-B-Al-Ga, Nd-Fe-Dy-Co-B-Al-Ga, etc.

The starting powder is prepared by a method known in the art. For example, an R-Fe-B alloy produced in an inert atmosphere or in vacuum is pulverized usually by two steps of coarse pulverizing and fine pulverizing in a non-oxidizing atmosphere to have an average particle size of 4.0 to 5.0 μm (F.S.S.S.).

The present invention will be further described while referring to the following Reference Examples and Examples which should be considered to illustrate various preferred embodiments of the present invention.

EXAMPLE 1

An ingot having a chemical composition of 32% by weight of Nd, 1.1% by weight of B and a balance of Fe was mechanically pulverized to prepare a starting powder having an average particle size of 4.5 μm (F.S.S.S.). By using a die 9 having an inner diameter of 30 mm and Lm of 16 mm and a core 3 having an outer diameter of 22 mm, the precompacting steps were repeated four times while the starting powder was charged in the cavity 10 at a depth of 15 mm for each precompacting step to prepare a four-stack precompact body. After shifting the precompact body stack to the space surrounded by the non-magnetic portion 2, a final amount of the starting powder was charged in the cavity 10 at a depth of 15 mm and compacted by the upper punch 4 to form a final compact body. In each run of producing the final compact body, the density of the precompact bodies was selected from the range of 2.9 g/cm$^3$ to 4.2 g/cm$^3$. The density of the final compact body was 4.2 g/cm$^3$ for each run. During the compacting steps, a magnetically saturated orientation magnetic field was applied to the starting powder.

Figure 4:
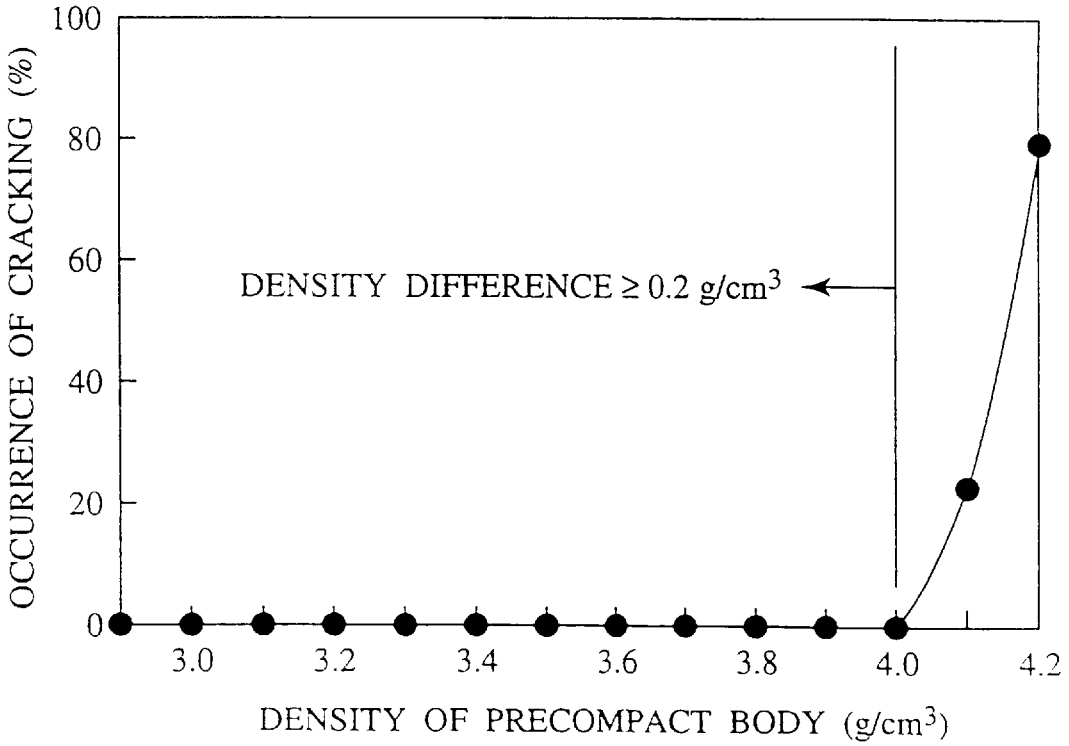
FIG. 4 is a graphic representation showing the dependency of the occurrence of cracking in the R.R. magnet on the density of the precompact body.

The final compact bodies (100 bodies for each run) thus obtained were sintered at 1100° C. for 2 hours in vacuum of $5\times10^{-4}$ to $7\times10^{-4}$ Torr. After the sintering, the occurrence of cracking at the binding portions was examined on each sintered product. The results are shown in FIG. 4. From FIG. 4, it can be seen that the cracking does not occur when the density of the precompact body is 4.0 g/cm$^3$ or less, namely the cracking does not occur when the density difference between the final compact body and the precompact body is 0.2 g/cm$^3$ or more. When the density of the precompact body exceeds 4.0 g/cm$^3$, namely the density difference is smaller than 0.2 g/cm$^3$, the occurrence of the cracking abruptly increases. Particularly, the cracking occurred in 80% of the sintered products when the density of the precompact body and the density of the final compact body were the same. From the results, it has been confirmed that the cracking during the sintering process can be effectively prevented when the density of the final compact body is at least 0.2 g/cm$^3$ higher than the density of the precompact body.

EXAMPLE 2

Figure 5:
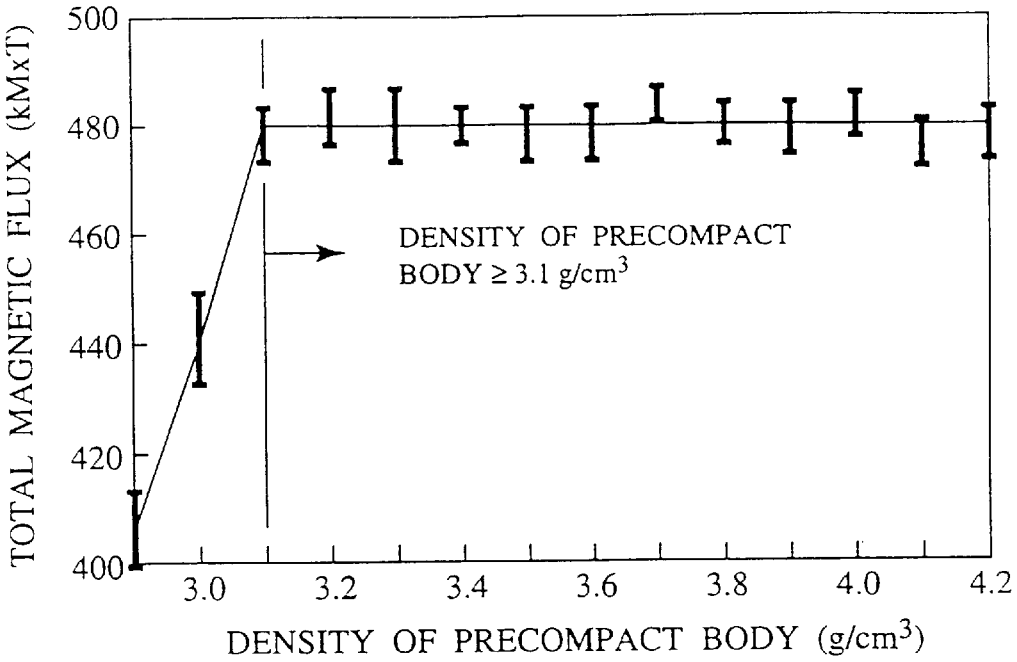
FIG. 5 is a graphic representation showing the dependency of the total magnetic flux of the R.R. magnet on the density of the precompact body.

Each of the sintered products obtained in the same manner as in Example 1 was successively heat-treated at 900° C. for 2 hours and 600° C. for 2 hours each in Ar atmosphere, ground and surface-treated by resin coating. The products thus treated were magnetized to obtain R.R. magnets (outer diameter: 25 mm, inner diameter: 19 mm, axial length: 30 mm) having 8 poles on the outer peripheral surface thereof. The total magnetic flux was measured on each magnet, and the results of the measurements are shown in FIG. 5. As seen from the results, the R.R. magnet constantly shows a high total magnetic flux when the density of the precompact body is 3.1 g/cm$^3$ or more, namely when the density is within the range specified in the present invention. When the density was less than 3.1 g/cm$^3$, the total magnetic flux density was extremely low as shown in FIG. 5.

Thus, the results of Examples 1 and 2 evidently show that the cracking during the sintering process can be effectively avoided and a high total magnetic flux can be attained when the conditions specified in the present invention, namely the precompact body density of 3.1 g/cm$^3$ or more and the density difference (final compact body density−precompact body density) of 0.2 g/cm$^3$ or more, are satisfied.

EXAMPLE 3

Figure 6:
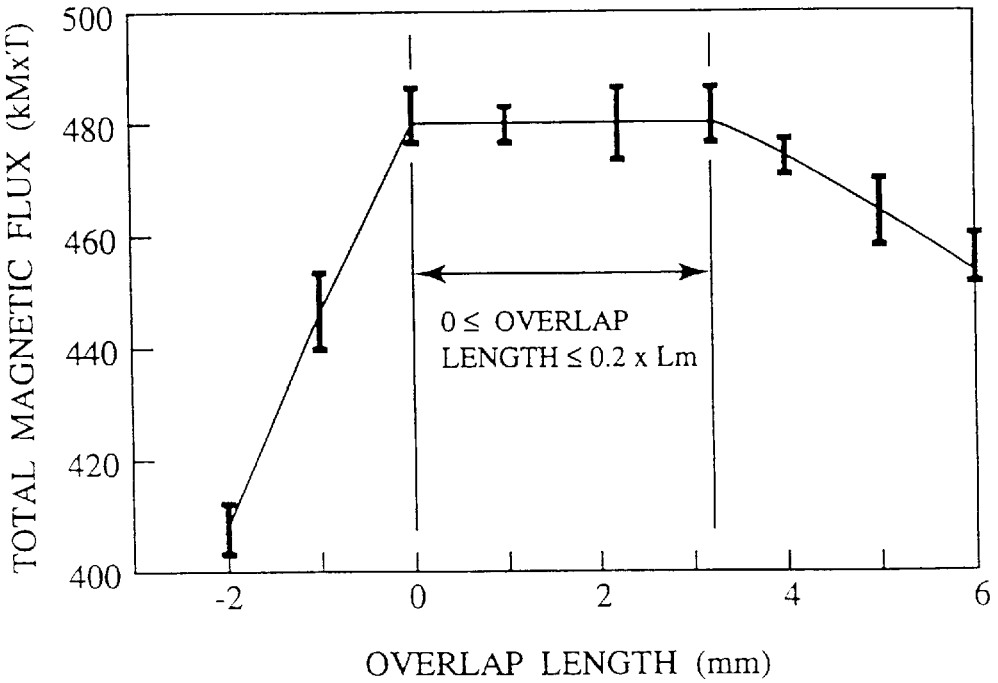
FIG. 6 is a graphic representation showing the dependency of the total magnetic flux of the R.R. magnet on the overlap length.

The same procedure of Example 1 was repeated while changing the overlap length to prepare each final compact body of five stacks. The density was 3.6 g/cm$^3$ for the precompact bodies and 4.1 g/cm$^3$ for the final compact body. Each final compact body was sintered, heat-treated, machined, surface-treated and magnetized in the same manner as in Example 2 to obtain each R.R. magnet having a size of 25 mm (outer diameter)×19 mm (inner diameter)×30 mm (axial length). The total magnetic flux was measured on each R.R. magnet, and the results thereof are shown in FIG. 6. The negative values of the overlap length mean that a lower part of the charged starting powder was placed in the cavity surrounded by the non-magnetic portion of the die. In this case, the total magnetic flux abruptly decreased with negatively increasing overlap length. In the region where the overlap length exceeds 3.2 mm, namely larger than 20% of Lm (16 mm), the total magnetic flux gradually decreased with increasing overlap length. Thus, the results show that the overlap length is 20% or less of Lm to attain high magnetic properties.

EXAMPLE 4

The same starting powder as in Example 1 was subjected to multi-stage compaction using a die shown in Table 1. When Lm was 16 mm, the compacting step was repeated five times while the charging depth of the stating powder was 15 mm for each compacting step. When Lm was 20 mm, the compacting step was repeated four times while the charging depth of the stating powder was 19 mm for each compacting step. The density was 3.6 g/cm$^3$ for each precompact body and 4.1 g/cm$^3$ for the final compact body. Each final compact body was sintered, heat-treated, machined, surface-treated and magnetized in the same manner as in Example 2 to obtain an R.R. magnet A (Lm=20 mm) and an R.R. magnet B (Lm=16 mm) each having a size of 25 mm (outer diameter)×19 mm (inner diameter)×30 mm (axial length). The total magnetic flux was measured on each R.R. magnet.

From the interbinding portion of each R.R. magnet, a test piece X having a size of 4 mm in the axial direction, 6 mm in the circumferential direction and 2.5 mm in the radial direction, and a test piece Y having a size of 30 mm in the axial direction, 6 mm in the circumferential direction and 2.5 mm in the radial direction were taken as shown in FIG. 3. B-H characteristics of each test piece in the radial direction and the circumferential direction were measured by a D.C. B-H tracer to determine the degree of orientation. The results are shown in Table 1.

Since Lm (20 mm) was larger than $d^2/D$ (16.1 mm), the die for producing the R.R. magnet A did not satisfy the formula (2). However, the total magnetic flux of the R.R. magnet A was nearly the same as that of the R.R. magnet B produced by a die satisfying the formula (2). Also, the degree of orientation in the interbinding portion of the R.R. magnet A was smaller than that of the R.R. magnet B. However, the R.R. magnet A and the R.R. magnet B were nearly the same in the degree of orientation with respect to the full length (L). Thus, it has been confirmed that good magnetic properties can be attained even when Lm is larger than the limit specified by the formula (2).

EXAMPLE 5

The same starting powder as in Example 1 was subjected to multi-stage compaction using a die shown in Table 1. When Lm was 45 mm, the compacting step was repeated three times while the charging depth of the stating powder was 44 mm for each compacting step. When Lm was 33 mm, the compacting step was repeated four times while the charging depth of the stating powder was 32 mm for each compacting step. The density was 3.8 g/cm$^3$ for each precompact body and 4.1 g/cm$^3$ for the final compact body. Each final compact body was sintered, heat-treated, machined, surface-treated and magnetized in the same manner as in Example 2 to obtain an R.R. magnet C (Lm=45 mm) and an R.R. magnet D (Lm=33 mm) each having a size of 50 mm (outer diameter)×39 mm (inner diameter)×46 mm (axial length). The total magnetic flux was measured on each R.R. magnet.

From the interbinding portion of each R.R. magnet, a test piece X having a size of 10 mm in the axial direction, 8 mm in the circumferential direction and 3 mm in the radial direction, and a test piece Y having a size of 46 mm in the axial direction, 8 mm in the circumferential direction and 3 mm in the radial direction were taken as shown in FIG. 3. B-H characteristics of each test piece in the radial direction and the circumferential direction were measured by a D.C. B-H tracer to determine the degree of orientation. The results are shown in Table 1.

Since Lm (45 mm) was larger than $d^2/D$ (33.75 mm), the die for producing the R.R. magnet C did not satisfy the formula (2). However, the total magnetic flux of the R.R. magnet C was nearly the same as that of the R.R. magnet D produced by a die satisfying the formula (2). Also, the degree of orientation in the interbinding portion of the R.R. magnet C was smaller than that of the R.R. magnet D. However, the R.R. magnet C and the RR. magnet D were nearly the same in the degree of orientation with respect to the full length (L) of the magnet. Thus, it has been confirmed that good magnetic properties can be attained even when Lm is larger than the limit specified by the formula (2). Also, by regulating Lm within the range which ensures a degree of orientation of 83 to 88% of the interbinding portion of the magnet, the number of compacting steps can be reduced while retaining high magnetic properties. Therefore, the production method of the present invention is advantageous also in view of reducing the production cost.

COMPARATIVE EXAMPLE 1

The same starting powder as in Example 1 was compacted by using the same die as used in Example 5 (Lm=33 mm) to prepare a green body having a density of 4.1 g/cm$^3$. The green body was sintered, heat-treated, machined and surface-treated in the same manner as in Example 2 to obtain a sintered product having a size of 50 mm (outer diameter)× 39 mm (inner diameter)×11.5 mm (axial length). Four sintered products were stacked and bonded using an adhesive to form a stacked product having an axial length of 46 mm, and then the stacked product was magnetized in the same manner as in Example 2 to produce a stacked magnet. The total magnetic flux measured on the magnet and the degree of orientation measured on the test piece X of 10 mm (axial direction)×8 mm (circumferential direction)×3 mm (radial direction) taken from the magnet as shown in FIG. 3 are shown in Table 1. Although the degree of orientation was the same as that of the R.R. magnet D of Example 5, the total magnetic flux was smaller than that of the R.R. magnet D.

EXAMPLE 6

In the same manner as the production of the R.R. magnet A of Example 4, a final compact body was prepared by repeating the compacting step five times while keeping the charging depth of the starting powder at 18.4 mm or changing the charging depth such that 19 mm for the first stage, 19.8 mm for the second stage, 18 mm for the third stage, 16.2 mm for the fourth stage and 19 mm for the fifth stage. Each of the final compact bodies was then sintered, heat-treated, machined, surface-treated and magnetized in the same manner as in Example 2 to obtain an R.R. magnet E (variable overlap length) and an R.R. magnet F (fixed overlap length) each having a size of 25 mm (outer diameter)×19 mm (inner diameter)×54 mm (axial length). The total magnetic flux measured on each magnet is shown in Table 1.

The length between the adjacent binding portions was determined by the distribution curve of surface magnetic flux density in the axial direction. The length for each pair of the adjacent binding portions was in the range of 7.2 to 5.9 mm. Since the minimum length (5.9 mm) was 82% of the maximum length (7.2 mm), each length ranged from 82 to 100% of the maximum length. Although the length between the adjacent binding portions was varied in the R.R. magnet E, the total magnetic flux was nearly the same as that of the R.R. magnet F which had a constant length.

2. The method according to claim 1, wherein said plurality of precompact bodies is formed by the steps of:

charging a first amount of a starting powder into a cavity, said die comprising a hollow cylindrical ferromagnetic portion, a hollow cylindrical non-magnetic portion concentrically fixed to a lower end surface of said ferromagnetic portion and a core concentrically and axially extending through an inner cylindrical space defined by an inner surface of said ferromagnetic portion and an inner surface of said non-magnetic portion, and said cavity being surrounded by said ferromagnetic portion;

compacting said first amount of said starting powder while applying an orientation magnetic field for orienting said starting powder in the radial direction to form a first precompact body;

shifting said first precompact body to an annular space surrounded by said non-magnetic portion to make said cavity empty;

repeating said charging step, said compacting step and said shifting step at least once to stack at least one precompact body on said first precompact body in series.

3. The method according to claim 2, wherein a final amount of said starting powder is charged in said cavity after said plurality of precompact bodies is shifted to said space surrounded by said non-magnetic portion to make said cavity empty, and said final amount of said starting powder is compacted together with said plurality of precompact bodies to form said integral final compact body.

TABLE 1

| | Size of die: Inner diameter (D) (mm) | Size of die: Outer diameter of core (d) (mm) | Lm (mm) | Number of stage | Density of precompact body (g/cm$^3$) | Density of final compact body (g/cm$^3$) | Total magnetic flux (kMxT) | Degree of Orientation: Interbinding portion (%) | Degree of Orientation: Full length (L) (%) | Remarks |
|---|---|---|---|---|---|---|---|---|---|---|
| | | | | | | Example 4 | | | | |
| A | 30 | 22 | 20 | 4 | 3.6 | 4.1 | 478–482 | 85 | 84 | — |
| B | 30 | 22 | 16 | 5 | 3.6 | 4.1 | 479–482 | 89 | 84 | — |
| | | | | | | Example 5 | | | | |
| C | 60 | 45 | 45 | 3 | 3.8 | 4.1 | 640–645 | 86 | 85 | — |
| D | 60 | 45 | 33 | 4 | 3.8 | 4.1 | 642–646 | 90 | 85 | — |
| | | | | | | Comparative Example 1 | | | | |
| | 60 | 45 | 33 | 1 | — | 4.1 | 630–633 | 90 | — | — |
| | | | | | | Example 6 | | | | |
| E | 30 | 22 | 20 | 5 | 3.6 | 4.1 | 602–607 | — | — | variable overlap length |
| F | 30 | 22 | 20 | 5 | 3.6 | 4.1 | 600–609 | — | — | fixed overlap length |

What is claimed is:

1. A method of producing a radially anisotropic sintered R-Fe-B-based magnet wherein R is at least one rare earth element including Y, which method comprises the steps of:

forming a plurality of precompact bodies in series in a die, each of said plurality of precompact bodies having a density of 3.1 g/cm$^3$ or more;

compacting said plurality of precompact bodies to form an integral final compact body having a density which is at least 0.2 g/cm$^3$ higher than that of said plurality of precompact bodies;

sintering said final compact body; and magnetizing a surface of the sintered body.

4. The method according to claim 2, wherein a length of said ferromagnetic portion in the axial direction is $2.5 \times d^2/D$ or less, wherein d is an outer diameter of said core and D is an inner diameter of said die.

5. A radially anisotropic sintered R-Fe-B-based magnet wherein R is at least one rare earth element including Y, comprising a stack of:

a first end magnet body portion having a first axial length;

an intermediate portion comprising at least a first intermediate magnet body portion adjacent to said first end magnet body portion and having a second axial length, and a second intermediate magnet body portion adjacent to said first intermediate magnet body portion and having a third axial length; and a second end magnet body portion adjacent to said second intermediate magnet body portion and having a fourth axial length;

wherein the axial length of each of the intermediate magnet body portions in said intermediate portion is 80 to 100% of the maximum axial length of said intermediate magnet body portions.

6. The radially anisotropic sintered R-Fe-B-based magnet according to claim 1, wherein each of said first and second end magnet body portions and said intermediate magnet body portions has a degree of orientation of 83 to 93%, said degree of orientation being defined by the following formula:

$$\text{degree of orientation}(\%)=Br(r)/(Br(r)+Br(c))\times 100$$

wherein Br(r) is a residual magnetic flux density in the radial direction and Br(c) is a residual magnetic flux density in the circumferential direction.

7. A radially anisotropic sintered R-Fe-B-based magnet wherein R is at least one rare earth element including Y, comprising a stack having at least first and second magnet body portions in series, wherein each of said magnet body portions has a degree of orientation of 83 to 88%, said degree of orientation being defined by the following formula:

$$\text{degree of orientation}(\%)=Br(r)/(Br(r)+Br(c))\times 100$$

wherein Br(r) is a residual magnetic flux density in the radial direction and Br(c) is a residual magnetic flux density in the circumferential direction.

8. The radially anisotropic sintered R-Fe-B-based magnet according to claim 7, wherein said magnet comprises a stack of:

a first end magnet body portion having a first axial length;

an intermediate portion comprising at least a first intermediate magnet body portion adjacent to said first end magnet body portion and having a second axial length, and a second intermediate magnet body portion adjacent to said first intermediate magnet body portion and having a third axial length; and a second end magnet body portion adjacent to said second intermediate magnet body portion and having a fourth axial length;

wherein the axial length of each of the intermediate magnet body portions in said intermediate portion is 80 to 100% of the maximum axial length of said intermediate magnet body portions.

9. A radially anisotropic sintered R-Fe-B-based magnet wherein R is at least one rare earth element including Y comprising a stack of a first end magnet body portion which was precompacted to a density of at least 3.1 g/cm$^3$, at least one intermediate magnet body portion which was precompacted to a density of at least 3.1 g/cm$^3$, and a second end magnet body portion which is compressed;

wherein prior to sintering, the magnet body portions are unified and compressed to a density at least 0.2 g/cm$^3$ larger than that of the precompacted first end magnet body portion or the precompacted intermediate portion.

10. The radially anisotropic sintered R-Fe-B-based magnet of claim 9, wherein the first end magnet body portion was precompacted to a density of 3.1–4.2 g/cm$^3$.

11. The radially anisotropic sintered R-Fe-B-based magnet of claim 9, wherein the intermediate magnet body portion was precompacted to a density of 3.1–4.2 g/cm$^3$.

12.The radially anisotropic sintered R-Fe-B-based magnet of claim 9, wherein the magnet body portions are unified and compressed to a density of 0.2–1.5 g/cm$^3$ larger than that of the precompacted first end body portion or the precompacted intermediate body portion.

13. The radially anisotropic sintered R-Fe-B-based magnet according to claim 9, wherein each of said first end magnet body portions and said intermediate magnet body portions has a degree of orientation of 83 to 93%, said degree of orientation being defined by the following formula:

$$\text{degree of orientation}(\%)=Br(r)/(Br(r)+Br(c))\times 100$$

wherein Br(r) is a residual magnetic flux density in the radial direction and Br(c) is a residual magnetic flux density in the circumferential direction.

* * * * *